United States Patent [19]

Nixon, III

[11] Patent Number: 4,947,753

[45] Date of Patent: Aug. 14, 1990

[54] STUN GRENADE

[76] Inventor: William P. Nixon, III, P.O. Box 17082, Memphis, Tenn. 38187-0082

[21] Appl. No.: 379,648

[22] Filed: Jul. 14, 1989

[51] Int. Cl.[5] ..... F42B 27/00

[52] U.S. Cl. ..... 102/487; 102/269

[58] Field of Search ..... 102/269, 334, 368, 395, 102/482, 487, 488, 498, 529; 206/3, 591, 592

[56] References Cited

U.S. PATENT DOCUMENTS

| | | | |
|---|---|---|---|
| 1,539,609 | 5/1925 | Taylor | 102/498 |
| 2,308,480 | 1/1943 | Abbott et al. | 206/3 |
| 2,405,085 | 7/1946 | Zappone | 102/487 |
| 2,817,294 | 12/1957 | Hjellnes | 102/33 |
| 2,960,934 | 11/1960 | Jackson et al. | 102/482 |
| 4,007,690 | 2/1977 | Wildridge | 102/87 |
| 4,014,262 | 3/1977 | Betts | 102/28 |
| 4,060,034 | 11/1977 | Bowman et al. | 102/275.5 |
| 4,444,111 | 4/1984 | Luebbers | 102/360 |
| 4,466,330 | 8/1984 | Juretzek et al. | 86/20 |

FOREIGN PATENT DOCUMENTS

| | | | |
|---|---|---|---|
| 2007339 | 5/1979 | United Kingdom | 102/487 |

*Primary Examiner*—Charles T. Jordan
*Assistant Examiner*—Richard W. Wendtland
*Attorney, Agent, or Firm*—Walker & McKenzie

[57] ABSTRACT

A stun grenade for producing a non-lethal explosion. The stun grenade includes an elongated grenade body having a hollow interior, an open first end, and a closed second end; an ignitor fuse for creating an ignition spark when activated, the ignitor fuse being attached to and closing the open first end of the grenade body; and an explosive substance positioned within the interior of the grenade body at the second end thereof for exploding when the ignitor fuse means creates an ignition spark.

11 Claims, 3 Drawing Sheets

STUN GRENADE

BACKGROUND OF THE INVENTION

1. Field of the Invention:

The present invention relates, in general, to stun grenades for use by SWAT teams and the like as nonlethal means in certain tactical situations 2. Information Disclosure Statement:

A preliminary patentability search conducted in class 102, subclasses 355, 360, 361, 498 and 529 produced Hjellnes, U.S. Pat. No. 2,817,294; Wildridge, U.S. Pat. No. 4,007,690; Betts, U.S. Pat. No. 4,014,262; Luebbers, U.S. Pat. No. 4,444,111; and Juretzek et al., U.S. Pat. No. 4,466,330.

Law enforcement agencies, especially SWAT teams (Special Weapons and Tactics teams, also known as Special Response teams, Mostage Rescue teams, Tactical Units, etc.) use diversionary devices called Stun grenades or Flash-bang grenades in certain tactical situations. Such a device traditionally consists of a short time delay fuse and an explosive charge. In typical situations, the stun grenade would be used in conjunction with an assault on one or more armed, barricaded suspects and which may involve hostages. The device would be brown into the room containing the suspects just prior to the assault. The objective of using the grenade would not be to hurt the suspects (or hostages), but to temporarily disorient and blind the suspects so they could be apprehended. The "stun" or disorienting effect comes from the loud explosion and the blinding effect is a result of the flash which accompanies the explosion. The Luebbers patent discloses a crowd control projectile and a method of ejecting flash and acoustic shock charges from the crowd control projectile.

The products on the market today use a variety of techniques to accomplish their objectives. The most popular design uses a one second delay fuse, a separator charge and a cardboard container with a magnesium aluminum-perclorate mixture. After throwing, the separator charge ejects the explosive container away from the fuse body, then another short fuse allows the explosive canister to get a short distance away from the fuse body before exploding. The fuse body, which is usually zino, is potentially the most dangerous part of the grenade. If the design does not prevent the fuse body from being expelled at high velocity, then the fuse body can become a dangerous projectile. There are several problems with this design. First, the separator charge is a critical element. If the separations delay is too short, then the objective is defeated and the fuse body may become a dangerous piece of shrapnel. If the delay is too long, the device may not explode in the area thrown. It may be thrown back at the SWAT team or at a hostage. If the separator charge does not initiate the time fuse in the explosive canister, then the device will fail to operate. This condition may require an explosive ordinance disposal unit (bomb squad) to render the device safe.

While the magnesium-aluminum perclorate mixture produces the desired noise and flash, it also produces large quantities of smoke and has the capability to start fires. The cardboard container is, in many cases, reduced to glowing embers which can start secondary fires.

One of the objects of developing the present invention was in response to difficulties experienced by law enforcement agencies with prior stun grenades. One of the most immediate problems is the smoke produced by these prior units. Before assaulting a building, there has usually been a large volume of tear gas delivered to the target. A stun grenade which produces a large volume of smoke will, when combined with the tear gas, make visibility virtually impossible for the entry team. If they wait for the smoke to clear, the stun effect has worn off and the suspect may have regained is night vision. These factors negate the purpose of the stun grenade.

Another disadvantage of these systems is the fire and shock sensitivity. Devices using the magnesium-aluminum perclorate mixture will explode if subjected to fire or shot with a bullet, especially a high velocity or supersonic round. Stun grenades of this nature are known as pyrotechnics or deflagration devices. They are very similar to large fireworks which are usually classified by the Department of Transportation as "Class B Explosive." Shipping Class B Explosives is difficult and expensive. United Parcel Service does not ship Class B explosives. These concerns also create problems in manufacturing. Rigid quality controls must be in effect to assure the separations charge work reliably. Large volumes of volatile, combustible and explosive materials create real dangers to personnel. These and other factors increase the manufacturing costs. Therefore, the cost of each device is very high, usually $60 to $80 each. Most law enforcement departments cannot afford to train with products which are this expensive.

Some departments use "grenade simulators" and the like in place of stun grenades because of cost, reliability and availability. Such simulators are disclosed by the above identified Hjellnes, Wildridge, Betts, and Juretzek patents. None of these simulators disclose or suggest the present invention. The present inventor is aware of a grenade simulator identified as model M116A1 (modified) used by the U.S. military for training purposes. The M116A1 (modified) military grenade simulator contains no provision to prevent fuse fragmentation and is not suitable in tactical situations, especially where hostages are involved.

None of the known prior art disclose or suggest the present invention. More specifically, none of the known prior art disclose or suggest a stun grenade comprising an elongated grenade body having a hollow interior, an open first end, and a closed second end; igniter fuse means for creating an ignition spark when activated, the igniter fuse means being allowed to the open first end of the grenade body; and explosive means positioned within the interior of the grenade body at the second end thereof for exploding when the igniter fuse means creates the ignition spark.

SUMMARY OF THE INVENTION

The stun grenade of the present invention includes an elongated grenade body having a hollow interior, an open first end, and a closed second end; igniter fuse means for creating an ignition spark when activated, the igniter fuse means being attached to and closing the open first end of the grenade body; and explosive means positioned within the interior of the grenade body at the second end thereof for exploding when the igniter fuse means creates the ignition spark.

The concept of the present invention is to provide a stun grenade that is completely safe to the user(s), that is completely safe to the suspect(s), that is completely safe to any hostage(s), that will incapacitate the suspect(s), that will not start fires, that will not create fragmentation and projectiles, that will explode exactly where thrown, that will not create smoke, that will cause a bright flash and a loud explosion, that is simple to use, that is shippable by common carriers such as United Parcel Service, that is economical enough for training purposes, that has a short delay (1 to 2 seconds), that is very reliable, that is water proof, that is not dangerous if exposed to fire, that is compact, that can be safely stored, that is of variable power, that is easy and safe to disarm, and that will not explode if hit by a bullet.

DESCRIPTION OF THE PREFERRED EMBODIMENT

Figure 1:
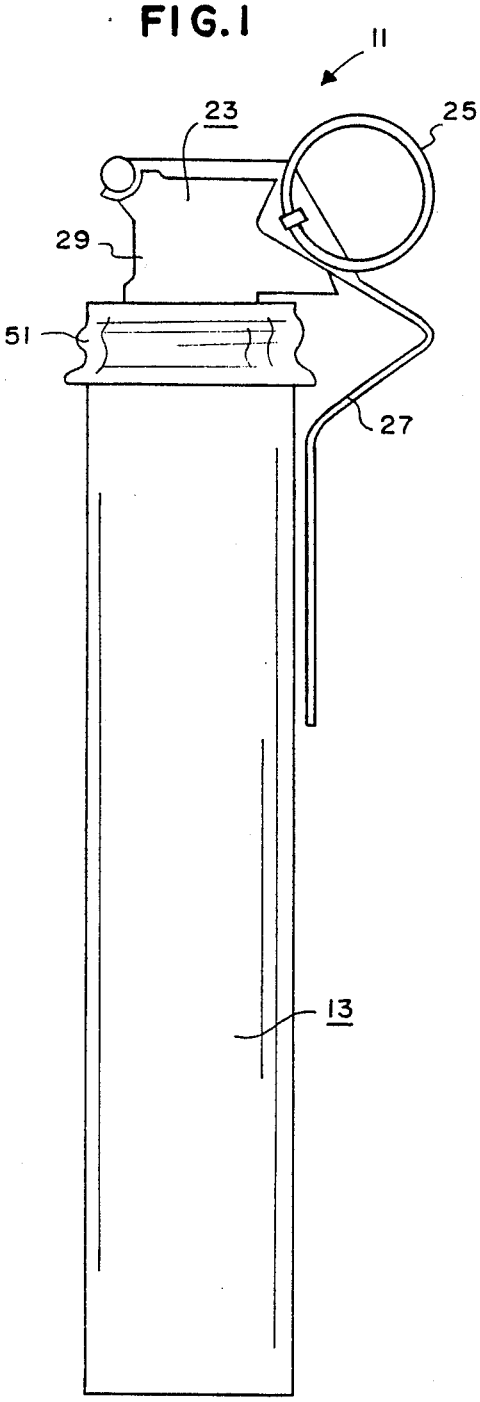
FIG. 1 is a front elevational view of the stun grenade of the present invention.

The stun grenade 11 of the present invention is for use by SWAT teams and the like for producing a non-lethal explosion to temporarily disorient and/or disable suspects, terrorists, etc.

The stun grenade 11 includes an elongated grenade body 13 having a hollow interior 15, an open first end 17, and a closed second end 19. The grenade body 13 preferably includes external screw threads 21 at the first end 17 thereof. The grenade body 13 may be constructed in various sizes and out of various materials. For example, the grenade body 13 may consist of a plastic bottle having a diameter of 1⅜ inches (3.49 centimeters) and a length of approximately 7 inches (17.78 centimeters). The grenade body 13 may be molded or cast as a one-piece, integral unit out of polypropylene or polyetheylene plastic as will now be apparent to those skilled in the art or may be purchased as an off-the-shelf item.

The stun grenade 11 includes an igniter fuse means 23 for creating a ignition spark when activated. The ignitor fuse means 23 is adapted to be attached to the open first end 17 of the grenade body 18. The ignitor fuse means 23 preferably includes a pull ring assembly 25 a safety lever 27 (sometimes referred to as a "spoon"), and a spring-biassed striker (not shown) or the like mounted on or within a fuse body 29. The fuse body 29 preferably includes an externally threaded boss portion 80. When the pull ring assembly 25 is pulled and the safety lever 27 released, the striker will create an ignition spark as will now be apparent to those skilled in the art. The fuse body 29 is typically constructed of hard, substantially heavy metal which can become a dangerous projectile if thrown or otherwise propelled through the air as will now be apparent to those of ordinary skill in the art. While the specific construction and operation of the ignitor fuse means 23 may vary, it preferably consists of a model M201-A1 ignitor fuse manufactured by Martin Electronics, Rt 1 Box 700, Perry, FL 32347.

The stun grenade 11 includes explosive means 31 positioned within the interior 15 of the grenade body 13 at the second end 19 thereof for exploding when the ignitor fuse means 23 creates the ignition spark. The explosive means 31 preferably consists of a double base smokeless powder that will detonate, rather than burn or deflagrate, if subjected to a blasting cap (normally used in conjunction with high explosives such as dynamite). Such powder is shippable by common carriers such as United Parcel Service if properly packaged. Additionally, only a small volume of such powder is needed, which contributes to cost effectiveness and compactness. Further, such powder produces very little smoke, has little fire starting capability, is safe to store and manufacture, does not usually explode if subjected to fire or bullet impact, and promotes the idea of variable power. While the explosive means 31 may be of various specific quantity and types and may include various specific components for various specific effects as will now be apparent to those skilled in the art, the explosive means 31 preferably consists of ¾ ounce of Bullseye Pistol Powder manufactured by Hercules Inc., Wilmington DE 19894. Aluminum and the like may be added to the explosive means 31 to produce light when the mixture is detonated and thereby increase the flash created by the stun grenade 11.

The stun grenade 11 preferably includes a detonator means 33 for detonating the explosive means 31. The detonator means 33 may be of various types now apparent to those skilled in the art. More specifically, the detonator means 38 preferably consists of a model Mantespo #8 Fuse cap detonator having a 1.4 gram total weight including aluminum shell and manufactured by Petro Explo Inc., Arlington, TX. The detonator means 33 is preferably located with at least a portion thereof positioned within the explosive means 31. The detonator can be omitted if a spark sensitive explosive, such as an aluminum-perclorate mixture is used instead of the smokeless powder.

The stun grenade 11 preferably includes an elongated fuse tube 35 having a hollow interior 37, a first end 39 associated with the ignitor fuse means 23, and a second end 41 associated with the detonator means 33. The fuse tube 85 may be manufactured in various specific manners and in various specific sizes. Preferably, the fuse tube 35 consists of a standard, off-the-shelf rubber hose approximately ½ inch (1.27 centimeters) in diameter and approximately 5 inch (12.7 centimeters) in length.

The stun grenade 11 preferably includes a fast burning fuse means 43 positioned within the interior 37 of the fuse lube 35 and extending between the ignitor fuse means 23 and the detonator means 33 for conveying the ignition spark from the ignitor fuse means 23 to the detonator means 33. The fast burning fuse means 43 may be constructed in various specific manners of various specific materials as will now be apparent to those skilled in the art. Preferably, the fast burning fuse means 43 consists of an approximately 5 inch (12.7 centimeters) length of a standard fast burning fuse manufactured by Fire Fox Enterprises Inc., PO Box 5366, Pocatello, ID 83202.

Figure 2:
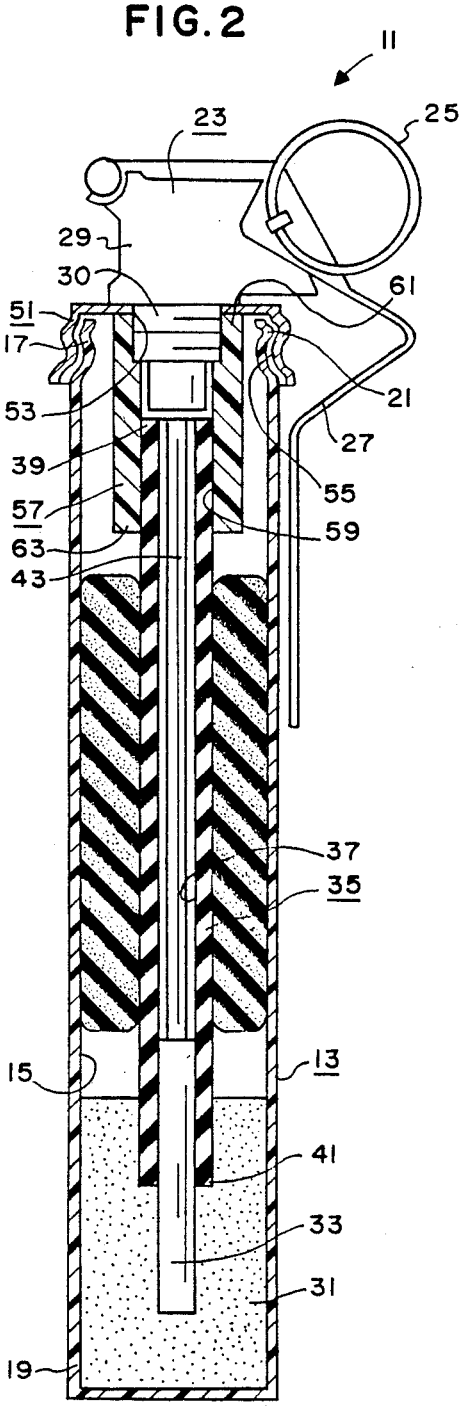
FIG. 2 is a sectional view of the stun grenade of the present invention.
Figure 3:
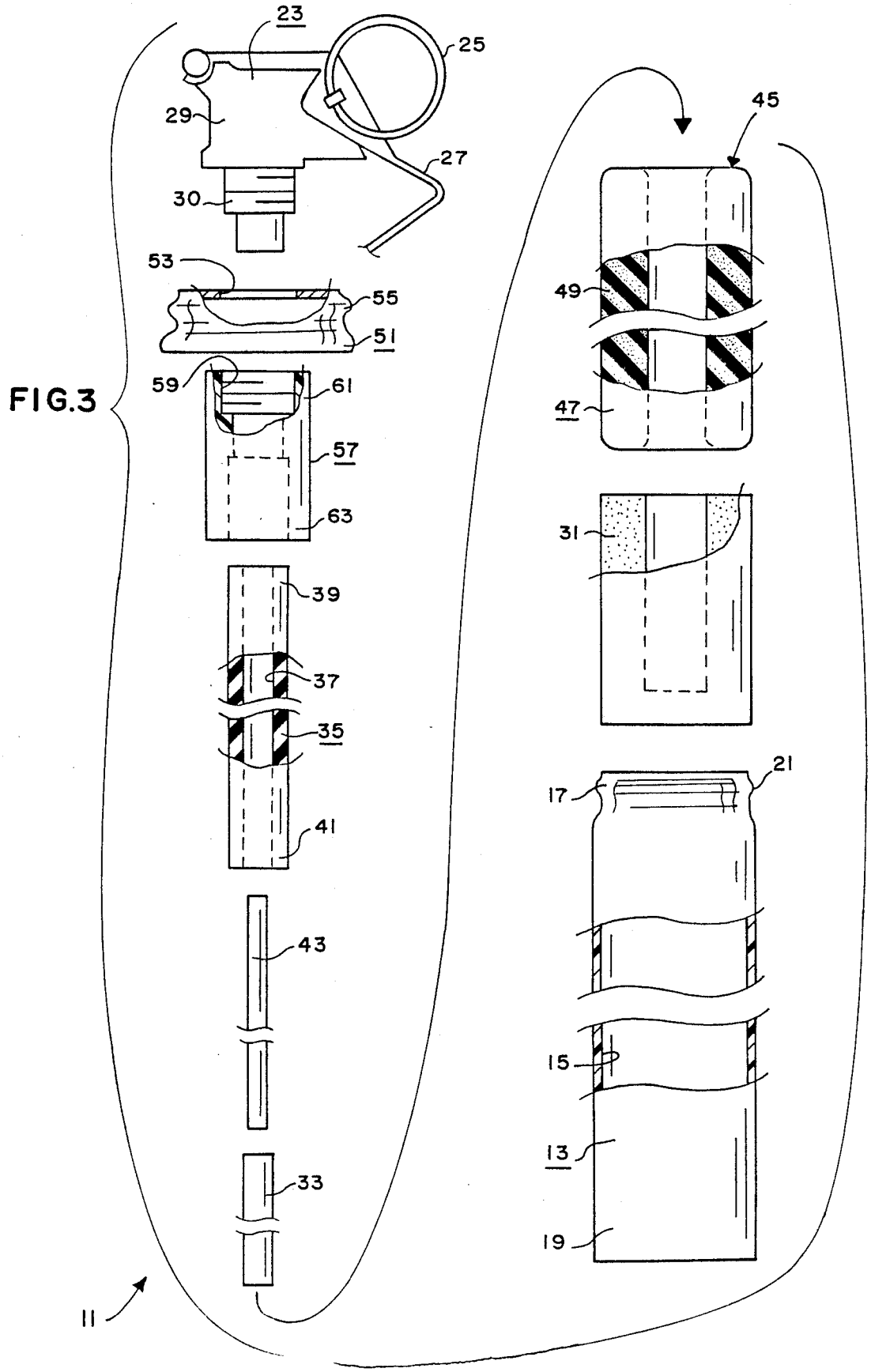
FIG. 3 is an exploded view of the stun grenade of the present invention with portions thereof broken away to better illustrate the structure thereof.

While locating the explosive means 31 at the opposite end of the elongated grenade body 13 from the fuse body 29 will tend to isolate the fuse body 29 from the explosive means 31, the stun grenade 11 preferably include isolation means 45 positioned within the interior 15 of the grenade body 13 between the first and second ends 17, 19 thereof for better isolating the fuse body 29 from the explosive means 31. The isolation means 45 preferably includes a resilient body 47 positioned between the first and second ends 17, 19 of the grenade body 13. The resilient body 47 is preferably constructed of closed cell foam rubber. More specifically, the resilient body 47 preferably consists of a closed cell foam cylinder 49 surrounding the fuse tube 35 at a point between the first and second ends 39, 41 thereof. The closed cell foam cylinder 49 is sized to completely fill the space between the interior wall of the grenade body 13 and the outer circumference of the fuse tube 35 as clearly shown in FIG. 2. Thus, the outer diameter of the closed cell foam cylinder 49 is preferably equal to or slightly larger than the inner diameter of the grenade body 13 and the inner diameter of the closed cell foam cylinder 49 is preferably equal to or slightly less than the outer diameter of the fuse tube 85 to insure a tight fit therebetween as will now be apparent to those skilled in the art. The isolation means 45 may be manufactured in various specific manners and of various specific materials and preferably consists of an approximately 3 inch (7.62 centimeters) length of standard, off-the-shelf closed cell foam ½ inch (1.27 centimeter) diameter pipe insulation or the like as will now be apparent to those skilled in the art. The resilient body 47 separates the ignitor fuse means 23 from the explosive means 31 to prevent shrapnel.

The stun grenade 11 preferably includes a cap 51 attached to the first end 17 of the grenade body 13. The cap 51 has an aperture 53 therethrough sized to allow the boss portion 30 of the fuse body 29 of the ignitor fuse means 23 to extend through the cap 51 and into the interior 15 of the grenade body 13. The cap 51 preferably has internal threads 55 for coacting with the external threads 21 of the grenade body 13 to allow the cap 51 to be securely screwed onto the first end 17 of the grenade body 13. The cap 51 may be constructed in various manners and out of various materials as will now be apparent to those skilled in the art. For example, the cap 51 may be stamped or otherwise formed out of sheet metal. Preferably, the cap 51 consists of an off-the-shelf unit with the aperture 53 drilled or stamped therein as will now be apparent to those skilled in the art.

The stun grenade 11 preferably includes a fuse nut 57 having a hollow interior 59, having a first end 61 for being attached to the boss portion 30 of the fuse body 29 of the ignitor fuse means 23 to secure the ignitor fuse means 23 to the cap 51 and having a second end 63 for being attached to the first end 39 of the fuse tube 35. The hollow interior 59 of the fuse nut 57 is preferably threaded at the first end 61 thereof to allow the fuse nut 57 to be securely screwed onto the externally threaded boss portion 30 of the fuse body 29 of the ignitor fuse means 28 and to clamp the cap 51 therebetween as clearly shown in FIG. 2. The fuse nut 57 may be manufactured in various specific manners and of various specific materials as will now be apparent to those skilled in the art. Preferably, the fuse nut 57 is machined out of a hard plastic material such as polyvinyl chloride or the like.

Figure 4:
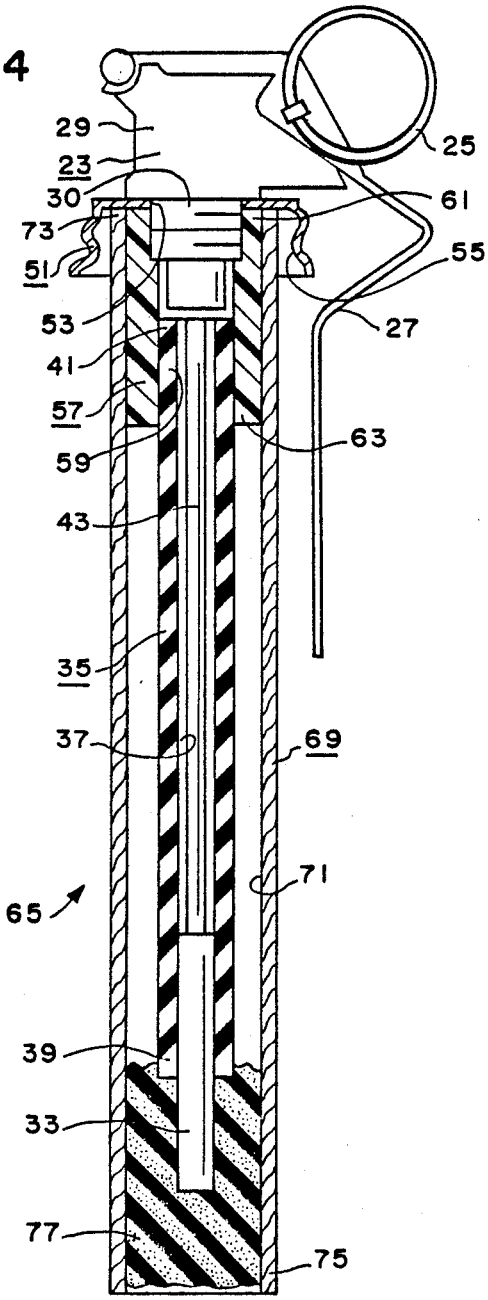
FIG. 4 is a sectional view of the detonating shipping package of the stun grenade of the present invention.
Figure 5:
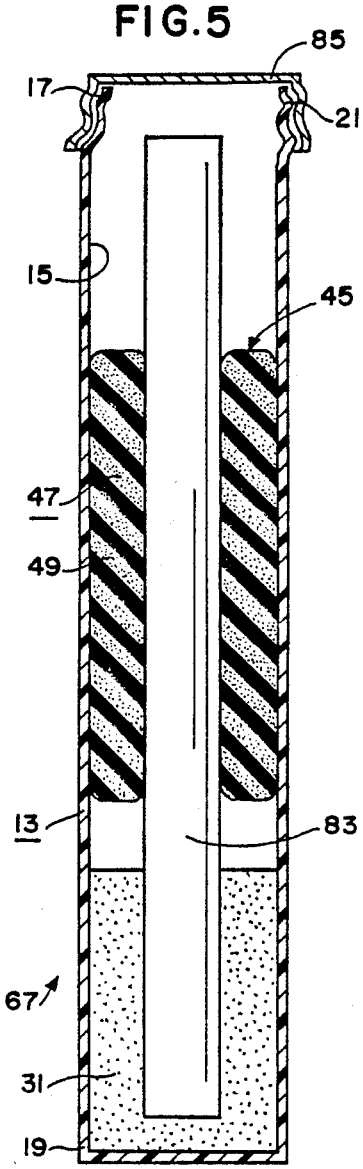
FIG. 5 is a sectional view of the explosive shipping package of the stun grenade of the present invention.

The present invention preferably includes a detonating shipping package 65 (see FIGS. 4 and 6) and an explosive shipping package 67 (see FIGS. 5 and 7) for allowing the component parts of the stun grenade 11 to be safely and economically shipped by common carriers such as United Parcel Service.

Figure 6:
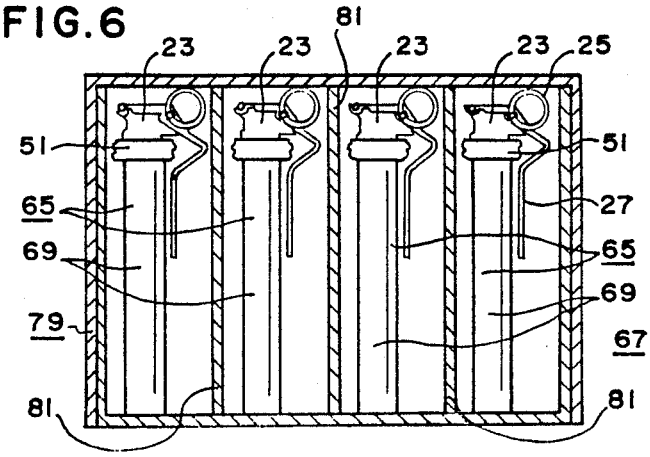
FIG. 6 is a section view of a shipping container with a plurality of the detonating shipping packages of the stun grenade of the present invention packed therein

The detonating shipping package 65 includes the stun grenade ignitor fuse means 28, the elongated fuse tube 35, the detonator means 33, and preferably the fuse means 43, cap 51 and fuse nut 57. The detonating shipping package 65 includes elongated preferably cardboard shipping lube 69 having a hollow interior 71 for receiving the fuse tube 35 and the detonator means 33. The shipping tube 69 has an open first end 78 associated with the ignitor fuse means 23 and preferably has an open second end 75. The shipping tube 69 is preferably sized so the interior 71 thereof will frictionally engage the outer walls of the fuse nut 57 to secure the shipping tube 69 thereto with the fuse tube 35 and detonator means 33 protected by the shipping tube 69. The detonating shipping package 65 preferably includes resilient packing means 77 for closing the second end 75 of the shipping tube 69. The resilient packing means 77 may consist of a plug of foam rubber or the like stuffed or otherwise secured within the second end 75 of the shipping tube 69 to give further protection to the fuse tube 35 and detonator means 33, etc., as will now be apparent to those skilled in the art. A shipping container 79 (e.g., a cardboard box) is provided for holding a plurality (e.g., 24) of the detonating shipping packages 65 as shown in FIG. 6. The shipping container 79 preferably includes dividers 81 for placement between each detonating shipping package 65.

Figure 7:
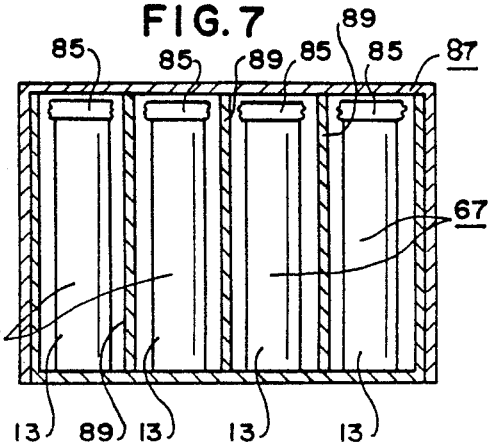
FIG. 7 is a sectional view of a shipping container with a plurality of the explosive shipping packages of the stun grenade of the present invention packed therein.

The explosive shipping package 67 includes the elongated stun grenade body 13, the explosive means 31 positioned within the interior 16 of the grenade body 13 at the second end 19 thereof, and the isolation means 45 positioned within the interior 15 of the grenade body 13 between the first and second ends 17, 19 thereof. Additionally, the explosive shipping package 67 includes a plug means 83 extending through the aperture 53 in the closed cell foam rubber cylinder 49 if the resilient body 47 of the isolation means 45 and into the explosive means 31 for closing the aperture 53 through the closed cell foam rubber cylinder 49; and cap means 85 for removably closing the first end 17 of the grenade body 13. A shipping container 87 (e g., a cardboard box) is provided for holding a plurality e.g., 24) of the explosive shipping packages 67 as shown in FIG. 7. The shipping container 87 preferably includes divider 89 for placement between each explosive shipping package 67.

Since the stun grenade 11 explodes in the area thrown, more accurate placement is possible than with the "separation" method. Therefore, although there is a powerful explosion at close range using the stun grenade 11, it can be directed to the subject's direction and away from hostages, with confidence and accuracy. Further, because of the way the stun grenade 11 is designed, the explosive means 31 can be varied depending on the requirements. For example, a small room with hostages would require less explosive power than a large room or building which only contained one or more subjects with no hostages. The ability to change the explosive charge also allows custom charges, if required, such as smoke, flash or other combinations. This also allows training loads which meet the safely and noise requirements of the specific location.

The present invention provides a stun grenade that is compact and allows the use of common SMG magazine pouches as holders. Since the grenade body 13 is preferably translucent, it is possible to see the condition and quantity of the explosive means 31. Since the stun grenade 11 is user serviceable, it is very easy to render safe by disassembling. The stun grenade 11 is reliable, simple to use and economical.

Although the present invention has been described and illustrated with respect to a preferred embodiment and a preferred use therefor, it is not to be so limited since modifications and changes can be made therein which are within the full intended scope of the invention.

I claim:

1. A stun grenade for producing a non-lethal explosion, said stun grenade comprising, in combination:

(a) an elongated grenade body having a hollow interior, an open first end, and a closed second end;

(b) ignitor fuse means for creating an ignition spark when activated, said ignitor fuse means being attached to said open first end of said grenade body; said ignitor fuse means including a hard, heavy fuse body constructed of metal;

(c) explosive means positioned within said interior of said grenade body at said second end thereof for exploding when said ignitor fuse means creates said ignition spark; and (d) isolation means positioned within said interior of said grenade body between said first and second ends thereof for isolating said explosive means from said fuse body.

2. The stun grenade of claim 1 in which said isolation means includes a resilient body positioned between said first and second ends of said grenade body.

3. The stun grenade of claim 2 in which said resilient body is constructed of closed cell foam rubber.

4. The stun grenade of claim 1 in which is included detonator means coupled to said explosive means and said ignitor fuse means for detonating said explosive means when said ignitor fuse means creates said ignition spark.

5. The stun grenade of claim 4 in which is included an elongated fuse tube having a hollow interior, a first end attached to said ignitor fuse means, and a second end attached to said detonator means.

6. The stun grenade of claim 5 in which is included fuse means positioned within said interior of said fuse tube and extending between said ignitor fuse means and said detonator means for conveying said ignition spark from said ignitor fuse means to said detonator means.

7. The stun grenade of claim 6 in which is included a cap attached to said first end of said grenade body, said cap having an aperture therethrough; and in which said fuse body of said ignitor fuse means has a boss portion for extending through said aperture in said cap and into said interior of said grenade body.

8. The stun grenade of claim 7 in which is included a fuse nut having a first end attached to said boss portion of said ignitor fuse means to secure said ignitor fuse means to said cap and having a second end attached to said first end of said fuse tube.

9. The stun grenade of claim 8 in which said isolation means includes a closed cell foam cylinder surrounding said fuse tube between said first and second ends thereof, the outer diameter of said closed cell foam cylinder being equal to the inner diameter of said grenade body, the inner diameter of said closed cell foam cylinder being equal to the outer diameter of said fuse tube.

10. The stun grenade of claim 9 in which at least a portion of said detonator means is positioned within said explosive means.

11. The stun grenade of claim 1 in which the length of said body is at least three times greater than the maximum width of said body.

* * * * *